US006290109B1

(12) United States Patent
Bougamont et al.

(10) Patent No.: US 6,290,109 B1
(45) Date of Patent: Sep. 18, 2001

(54) DISPENSING HEAD FOR LIQUID PRODUCT CONTAINER

(75) Inventors: Jean-Louis Bougamont; Jean-Pierre Alleard, both of Eu; David Leuliet, Mers les Bains, all of (FR)

(73) Assignee: Rexam Sofab, LeTreport (FR)

( * ) Notice: Subject to any disclaimer, the term of this patent is extended or adjusted under 35 U.S.C. 154(b) by 0 days.

(21) Appl. No.: 09/581,524

(22) PCT Filed: Jan. 7, 1999

(86) PCT No.: PCT/FR99/00013

§ 371 Date: Jul. 6, 2000

§ 102(e) Date: Jul. 6, 2000

(87) PCT Pub. No.: WO99/35047

PCT Pub. Date: Jul. 15, 1999

(30) Foreign Application Priority Data

Jan. 7, 1998 (FR) ..... 93 00093

(51) Int. Cl.[7] ..... B65D 47/00
(52) U.S. Cl. ..... 222/546; 239/506
(58) Field of Search ..... 252/546, 529; 239/506

(56) References Cited

U.S. PATENT DOCUMENTS

| | | | | |
|---|---|---|---|---|
| 152,980 | * | 7/1874 | Donkin | 222/546 |
| 2,677,482 | * | 5/1954 | Lehmann | 222/546 |
| 2,717,721 | * | 9/1955 | Gibson | 222/546 |
| 4,401,272 | * | 8/1983 | Merton et al. | 222/546 |

FOREIGN PATENT DOCUMENTS

| | | | | |
|---|---|---|---|---|
| 1206792 | * | 9/1970 | (GB) | 222/546 |

* cited by examiner

*Primary Examiner*—Philippe Derakshani
*Assistant Examiner*—Thach H Bui
(74) *Attorney, Agent, or Firm*—Bacon & Thomas, PLLC

(57) ABSTRACT

The invention relates to a dispenser head for a receptacle (R) for a liquid, the receptacle being of the type comprising a manual bearing face (1) for actuating the delivery means (P) for delivering the liquid, and an ejection nozzle (2) provided with an internal evacuation duct (20) that is suitable for being fed by said delivery means via a connection element (3) that may or may not be removable, the dispenser head being characterized in that the nozzle (2) is constituted by a hollow rod (21) inclined towards the receptacle (R) and adapted to receive a removable cap (4) that is constituted by a tube (40) closed at one end and designed to be slidably fitted over the outside of said rod (21), via its other end.

14 Claims, 1 Drawing Sheet

DISPENSING HEAD FOR LIQUID PRODUCT CONTAINER

BACKGROUND OF THE INVENTION

1. Field of the Invention

The present invention relates to a dispenser head for a receptacle for a liquid.

2. Description of the Related Art

Dispenser heads generally comprise a manual bearing face for actuating delivery means for delivering the liquid, and an ejection nozzle provided with an internal evacuation duct that is suitable for being fed by said delivery means via a connection element that may or may not be removable.

However, nozzles for conventional heads do not enable the liquid to be conveyed to a precise zone without resulting in significant losses.

Furthermore, after dispensing, nozzles always contain left-over liquid which thus remains in contact with the ambient air until the next dispensing sequence, and which is thus capable of becoming degraded or contaminated before its turn arrives to be dispensed.

Although caps designed to close nozzles already exist, using them is unsatisfactory because they are small, often causing them to be lost and/or go unnoticed when they are in place.

GB 1 206 792 (SPERRY RAND CORPORATION) describes a dispenser head for a receptacle for a liquid. The head comprises a manual bearing face for actuating delivery means for delivering the liquid, the means being constituted in this case by a valve and an ejection nozzle provided with an internal evacuation duct.

The nozzle is constituted by a hollow rod that is slightly inclined towards the receptacle. However, means are not provided to close said nozzle.

SUMMARY OF THE INVENTION

An object of the present invention is to resolve the technical problems linked to the prior art.

According to the invention, this object is achieved by means of a dispenser head for a receptacle for a liquid, the receptacle being of the type comprising a manual bearing face for actuating the delivery means for delivering the liquid, and an ejection nozzle provided with an internal evacuation duct that is suitable for being fed by said delivery means via a connection element that may or may not be removable, said nozzle being constituted by a hollow rod inclined towards the receptacle, the dispenser head being characterized in that said rod is adapted to receive a removable cap that is constituted by a tube designed to be slidably fitted over the outside of said rod, via one end, and closed at its other end by a transverse wall having an outside face that is concave and an inside face that carries a coaxial pin that is suitable for being slidably engaged in the internal duct of the nozzle.

The transverse wall preferably has a surface area that is greater than the section of the tube so as to form a stable support base for the cap.

According to a characteristic, the free end of the pin is of truncated section.

According to another characteristic, said nozzle is defined upstream of the duct by a shoulder forming an abutment for the end edge of said tube.

According to yet other characteristics the rod is inclined with an angle $\alpha$ lying in the range 0° to 150° relative to the axis of the receptacle, and the manual bearing face has a concave profile.

The head of the invention ensures a dispensing mode that is precise and cheap.

The inclination of the rod of the nozzle enables the head to be emptied completely, without it being necessary to turn the receptacle upside down.

Furthermore, the removable cap is very ergonomic. It is easily handled by the user and ensures very effective mechanical and hygienic protection for the rod.

The design of the dispenser head is original in appearance, and also serves technically to make it very stable and very easy to handle.

BRIEF DESCRIPTION OF THE DRAWING

The invention will be better understood on reading the following description accompanied by a drawing, in which.

DETAILED DESCRIPTION OF THE PREFERRED EMBODIMENT

Figure 3:
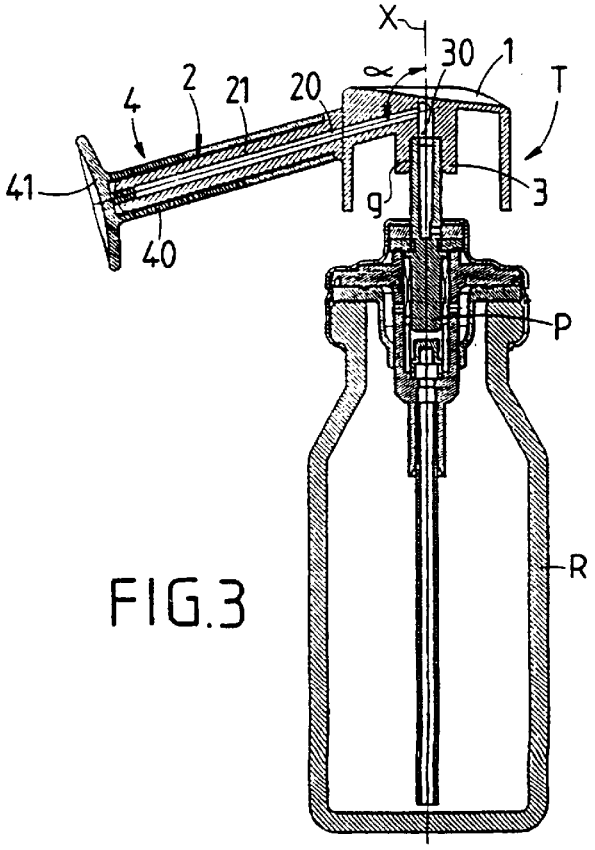
FIG. 3 is a section view of the embodiment of FIGS. 1 and 2 after assembly on a receptacle.

As shown in FIG. 3, the dispenser head of the invention is designed to be mounted on a receptacle R for a liquid.

The receptacle R is generally fitted with delivery means, such as a pump P, for delivering the liquid.

The head T comprises a manual bearing face 1 having a concave profile for actuating the delivery means P, and an ejection nozzle 2 provided with an internal evacuation duct 20. The duct 20 is suitable for being fed by the means P via a connection element 3 that is preferably removable.

Here, the connection element 3 is made in the shape of an internal sleeve having a bottom portion that covers the top portion of the outlet g of the pump P.

The outlet g thus opens out to a cylindrical axial bore 30 communicating at its top end with the evacuation duct 20 of the nozzle 2.

The head T can thus be separated easily from the receptacle R, thereby making the assembly simpler to package and store.

The nozzle 2 is constituted by a hollow rod 21 that is inclined outwards relative to the axis X of the receptacle R in the manner of a trumpet, at an angle $\alpha$ lying in the range 0° to 150° as a function of the intended application, and in the figures this angle is downwards at about 135°.

Figure 2:
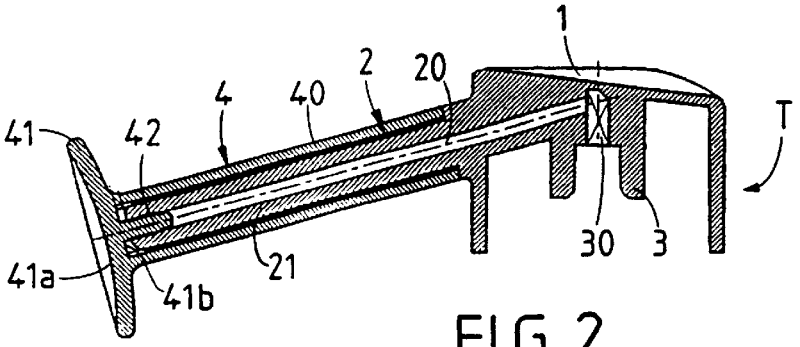
FIG. 2 is a section view of the embodiment of FIG. 1 with the nozzle in the closed position.

As shown in FIG. 2, the nozzle 2 is adapted to receive a removable cap 4 that is constituted by a tube 40 closed at one end and designed to be slidably fitted over the outside of the rod 21, via its other end.

The tube 40 is closed by a transverse wall 41 having an outside face 41a that is concave and an inside face 41*b* that carries a coaxial pin 42 designed to be slidably engaged in the duct 20 of the nozzle 2.

The free end 42*a* of the pin 42 is preferably of truncated section enabling it to be inserted easily and to slide easily in the duct 20.

In these conditions, a small amount of radial clamping exists, firstly between the inside wall of the tube 40 and the outside wall of the rod 21 of the nozzle 2, and secondly between the inside wall of the duct 20 and the pin 42, thereby making the assembly leakproof.

The nozzle 2 is defined upstream of the duct 20 by a shoulder 22 forming an abutment for the end edge of the tube 40 of the cap 4 while presenting a continuous cylindrical profile between the head T and said cap.

In the embodiment shown, the relative lengths of the tube 40 and of the rod 21 are such that in the assembled position (FIG. 2), a small gap exists in the bottom of the tube 40, between the end edge of the rod 21 and the wall 41.

Figure 1A:
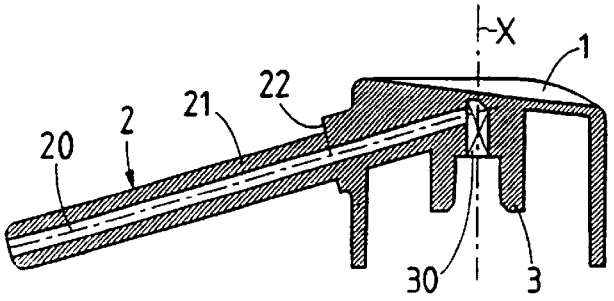
FIGS. 1A and 1B are section views of an embodiment of the dispenser head of the invention respectively showing the nozzle in the open position, and the cap in the vertical support position.
Figure 1B:
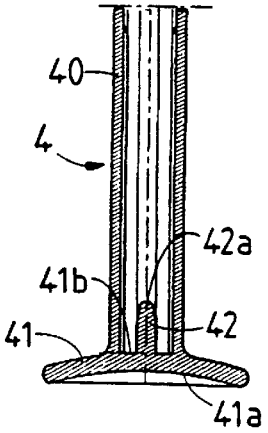

The transverse wall 41 of the cap 4 is of surface area that is greater than the section of the tube 40 so as to form a stable support base in order to hold the tube 40 in the vertical position as shown in FIG. 1*b*.

What is claimed is:

1. A dispenser head for a receptacle (R) for a liquid, the receptacle being of the type comprising a manual bearing face (1) for actuating the delivery means (P) for delivering the liquid, and an ejection nozzle (2) provided with an internal evacuation duct (20) that is suitable for being fed by said delivery means via a connection element (3) that may or may not be removable, said nozzle (2) being constituted by a hollow rod (21) inclined towards the receptacle (R), the dispenser head being characterized in that said rod is adapted to receive a removable cap (4) that is constituted by a tube (40) designed to be slidably fitted over the outside of said rod (21), via one end, and closed at its other end by a transverse wall (41) having an outside face (41*a*) that is concave and an inside face (41*b*) that carries a coaxial pin (42) that is suitable for being slidably engaged in the internal duct (20) of the nozzle (2).

2. A head according to claim 1, characterized in that said transverse wall (41) has a surface area that is greater than the section of the tube (40) so as to form a stable support base for the cap (4).

3. A head according to claim 1, characterized in that the free end (42*a*) of the pin (42) is of truncated section.

4. A head according to claim 1, characterized in that said nozzle (2) is defined upstream of the duct (20) by a shoulder (22) forming an abutment for the end edge of said tube (40).

5. A head according to claim 1, characterized in that the rod (21) is inclined with an angle ($\alpha$) lying in the range 0° to 150° relative to the axis (X) of the receptacle (R).

6. A head according to claim 1, characterized in that the manual bearing face (1) has a concave profile.

7. The head according to claim 1, wherein a radial clamp is formed firstly between an inside wall of the tube (40) and an outside wall of the rod (21), and secondly between an inside wall of the duct (20) and the pin (42).

8. A dispenser head for a receptacle housing a fluid, the dispenser head comprising:

a manual bearing face attachable to a delivery device and configured to actuate the delivery device to remove liquid from the receptacle connected to the delivery device, the manual bearing face comprises an ejection nozzle, the ejection nozzle comprises a hollow rod that forms an internal evacuation duct surrounded by an outside wall, the hollow rod comprises first and second ends, the internal evacuation duct at the first end of the hollow rod connectable to the delivery device via a connection element, the hollow rod inclined from the horizontal such that any liquid contained therein will flow toward its second end;

a removable cap comprising a tube and a transverse wall that closes off an end of the tube, the transverse wall comprising a concave outside face and an inside face; and the tube configured to be slidably fitted over the outside wall of the hollow rod, whereby the inside face of the transverse wall engages the second end of the hollow rod, and the inside face of the transverse wall comprises a coaxial pin sized and configured to be slidably engaged in the internal evacuation duct.

9. The head according to claim 8, wherein the transverse wall has a surface area that is greater than a cross section of the tube so as to form a stable support base for the cap.

10. The head according to claim 8, wherein the coaxial pin comprises a free end having a truncated section.

11. The head according to claim 8, wherein the nozzle is defined upstream of the duct by a shoulder forming an abutment for the tube.

12. The head according to claim 8, wherein the rod is inclined with an angle lying in the range 0° to 150° relative to a vertical axis of the receptacle.

13. The head according to claim 8, wherein the manual bearing face has a concave profile.

14. The head according to claim 8, wherein a radial clamp is formed firstly between an inside wall of the tube and the outside wall of the rod, and secondly between an inside wall of the duct and the pin.

* * * * *